US005816869A

United States Patent [19]

Willows

[11] Patent Number: 5,816,869

[45] Date of Patent: Oct. 6, 1998

[54] PROPELLER FOR VARYING THE EXHAUST LENGTH

[75] Inventor: Kurt D. Willows, West Bend, Wis.

[73] Assignee: Brunswick Corporation, Lake Forest, Ill.

[21] Appl. No.: 892,646

[22] Filed: Jul. 15, 1997

[51] Int. Cl.[6] ..... B63H 21/32

[52] U.S. Cl. ..... 440/89; 440/900; 416/93 A

[58] Field of Search ..... 440/88, 89, 113, 440/900, 66; 416/93 R, 93 A

[56] References Cited

U.S. PATENT DOCUMENTS

| | | | |
|---|---|---|---|
| 3,052,086 | 9/1962 | Kiekhaefer et al. . | |
| 3,434,447 | 3/1969 | Christensen et al. | 440/66 |
| 3,808,807 | 5/1974 | Lanpheer . | |
| 3,871,324 | 3/1975 | Snyder . | |
| 4,276,036 | 6/1981 | Nishida et al. | 440/89 |
| 4,388,070 | 6/1983 | Kasschau | 440/89 |
| 4,911,122 | 3/1990 | Corbett et al. . | |
| 4,911,666 | 3/1990 | Gage et al. . | |
| 5,119,778 | 6/1992 | Corbett . | |
| 5,470,263 | 11/1995 | Griffiths et al. . | |
| 5,527,195 | 6/1996 | Neisen . | |

*Primary Examiner*—Ed L. Swinehart
*Attorney, Agent, or Firm*—Andrus, Sceales, Starke & Sawall

[57] ABSTRACT

A propeller for a marine propulsion system that provides variable length exhaust paths depending upon the speed of the boat and motor. The propeller includes a propeller hub and an exhaust tube positioned within the propeller hub. The exhaust tube extends past the aft end of the propeller hub and defines a first exhaust passageway. A second exhaust passageway is positioned between the propeller hub and the exhaust tube. The second exhaust passageway is shorter than the first exhaust passageway. At low speeds, engine exhaust exits the longer first passageway, while at moderate speeds, engine exhaust exits the shorter second passageway. Therefore, the effective length of the exhaust path varies depending upon the speed of the motor, such that the length of the exhaust path is specifically tuned to several speeds of the motor.

12 Claims, 2 Drawing Sheets

FIG. 3
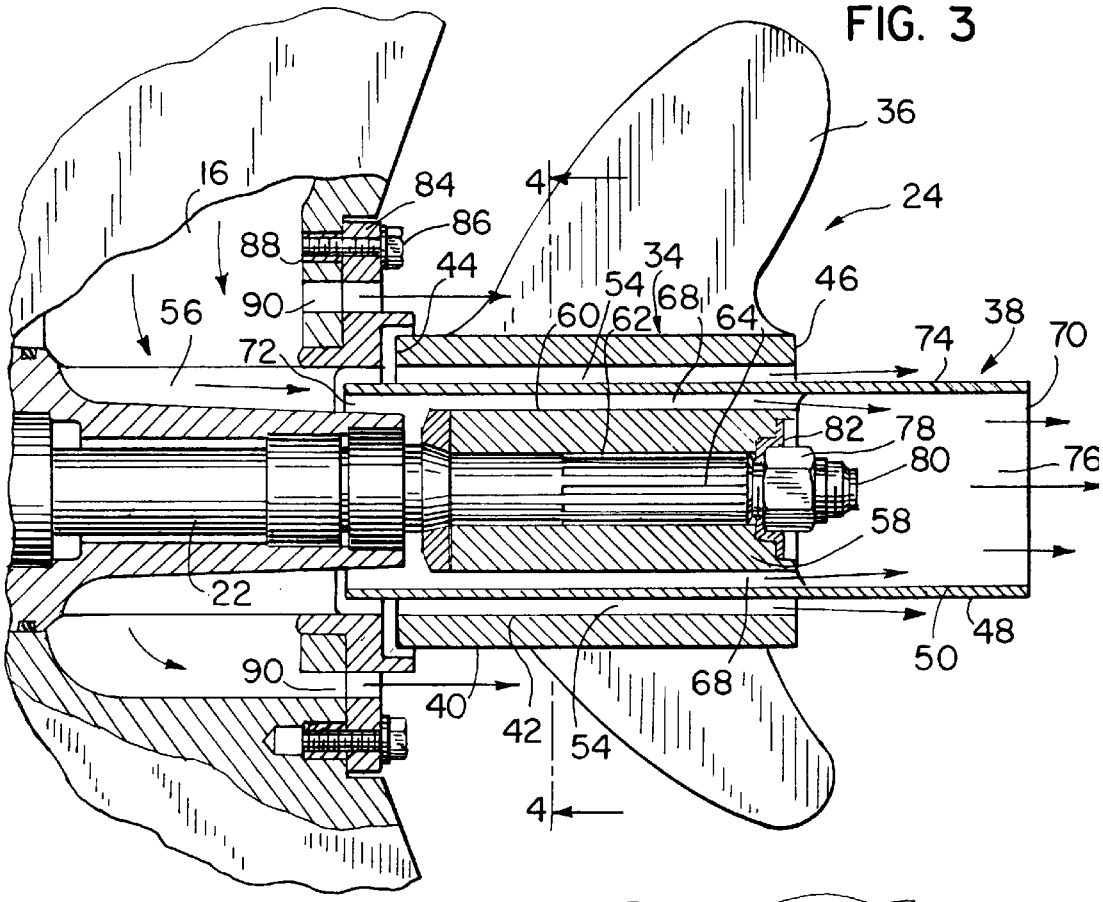
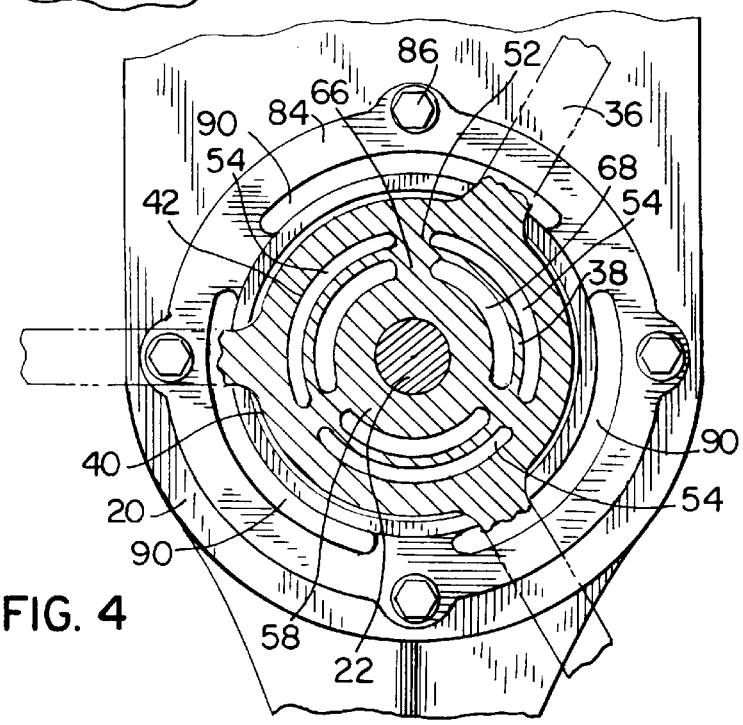
FIG. 4

PROPELLER FOR VARYING THE EXHAUST LENGTH

FIELD OF THE INVENTION

The invention relates to a propeller for a marine propulsion system. More specifically, the invention relates to a propeller having an outer hub and an exhaust tube which combine to vary the available exhaust path of the propulsion unit depending on the speed of the watercraft.

BACKGROUND OF THE INVENTION

In a two-cycle internal combustion engine, it is desired to efficiently scavenge each cylinder, particularly at high engine speeds, to ensure removal of all of the burned fuel mixture and replace it with a fresh charge of fuel-air mixture. Efficient scavenging produces an increase of power for a particular size engine and is necessary at high engine speeds because of the short duration of each cycle.

An effective method to aid in scavenging is to supply a negative pressure pulse in the exhaust manifold during the exhaust period. The negative pressure pulse lowers the pressure outside of the cylinder and evacuation of exhaust contained within the cylinder through the exhaust port is facilitated.

However, if the cylinders are improperly scavenged, for example if the negative pressure pulse arrives near the time of exhaust port closure, some of the fresh fuel charge will escape through the exhaust port before firing, thereby increasing the fuel consumption.

To prevent this increased fuel consumption due to the fresh mixture of fuel and air being pulled directly through the cylinder from the intake or transfer port through the exhaust port, a positive pressure pulse is applied at the exhaust port. With this arrangement, one is able to obtain increased power not only without increased fuel consumption, but with a considerably lower fuel consumption.

In operation of a two stroke cycle, when the exhaust valve opens, the violent blow down generates a strong positive pressure pulse which travels down the exhaust pipe at about sonic velocity and expands into the atmosphere at the end of the exhaust pipe. The pulse is reflected from the open end of the exhaust pipe as a strong negative rarefaction, which travels back through the exhaust pipe to the exhaust port. Selecting the proper length of the exhaust pipe, or "tuning" the engine, ensures that the rarefaction wave arrives at the exhaust port during the scavenging process of the two stroke cycle, or during the valve overlap period of a four stroke cycle.

Tuned exhaust systems have long been employed to improve the scavenging of internal combustion engines of the two-cycle variety. An exhaust pipe of a pre-determined length and varying cross section is provided to establish negative pressure waves during the exhaust cycle which improves the scavenging of the cylinders. Thus, it has been conventional to select an exhaust pipe that is tuned to the cylinders to increase the scavenging effect and thereby increase the speed of the engine.

In many present outboard motor and inboard/outboard motor constructions, including both two and four cycle engines, the exhaust path or "pipe" terminates through the propeller housing. By terminating the exhaust path through the propeller housing, the body of water muffles exhaust noise in a very effective manner. The dimensions of the exhaust path are typically selected to efficiently tune the engine for an average operating speed of the boat and motor. When the engine is operated at a speed above or below the average speed for which it is tuned, the fixed length of the exhaust path no longer provides optimum tuning. For example, at low engine speed, the exhaust path needs to be lengthened for optimum tuning, while at higher speeds, the exhaust path should be shortened. Since the length of the exhaust path through the propeller is fixed, optimum tuning is not provided over the entire operating range of the engine.

Therefore, it can be appreciated that a propeller in a marine propulsion system having a structure that can modify the length of the exhaust path as a result of engine speed to more optimally tune the engine would be desirable.

SUMMARY OF THE INVENTION

The invention is an exhaust system for a marine propulsion system which includes a propeller that varies the exhaust path depending upon the speed of the boat to more optimally tune the engine for a variety of engine speeds. The invention, therefore, allows the boat motor to be more optimally tuned for a variety of speeds, thereby improving the overall performance of the engine.

A propeller in accordance with the invention, includes an outer propeller hub and an inner, coaxial exhaust tube. The exhaust tube has an outer diameter smaller than the inner diameter of the propeller hub and is preferably joined to the propeller hub by a series of circumferentially spaced spokes extending between the outer surface of the exhaust tube and the inner wall of the propeller hub. The exhaust tube has a length longer than the length of the propeller hub, such that the exhaust tube extends rearward beyond the aft end of the propeller hub.

In accordance with the invention, the propeller includes a pair of exhaust passageways extending therethrough. Each of the exhaust passageways is in communication with the internal exhaust passage contained within the gear case of the outboard motor. The first exhaust passageway extends through the hollow interior of the exhaust tube and terminates at the aft end of the exhaust tube. The second exhaust passageway is an annular exhaust passage defined by the open area between the outer diameter of the exhaust tube and the inner wall of the propeller hub. The second exhaust passageway terminates at the aft end of the propeller hub.

In a preferred embodiment of the invention, a mounting bracket is connected to the aft end of the torpedo gearcase and is used to securely attach the propeller to the torpedo gearcase. The mounting bracket has a series of exhaust openings that are in communication with the internal exhaust passage contained in the gearcase. Therefore, in the preferred embodiment of the invention, the exhaust tuning system has three distinct exhaust paths, including the two paths through the propeller.

In operation of the boat with a propeller constructed in accordance with the invention, water flowing over the torpedo gearcase at low speeds will effectively block the second and third exhaust passageways such that exhaust pressure pulses will be effectively reflected through the first exhaust passageway at the aft end of the exhaust tube.

At moderate speeds, the water flowing over the torpedo gearcase effectively blocks off the third exhaust passageway that passes through the mounting bracket, while allowing exhaust pressure pulses from the engine to be effectively reflected through the second exhaust passageway at the aft end of the propeller hub and the first exhaust passageway at the aft end of the exhaust tube. Therefore, an exhaust path is available at moderate speeds that is shorter than the single exhaust path at low speeds.

During high speed boat operation, the water flowing over the torpedo gearcase does not block off any of the three exhaust passageways, thereby allowing exhaust pressure pulses to be reflected at the propeller mounting bracket. Therefore, at high speed operation, an exhaust path is available that is further shortened from the available exhaust paths either at low or moderate speeds. By varying the available exhaust path length depending upon the speed of the boat, the engine exhaust can be tuned selectively for low speed operation, moderate speed operation and even high speed operation if desired. The respective lengths of the exhaust tube and propeller hub can be selected to properly tune the engine for a variety of speeds. In this manner, the overall performance of the outboard motor can be increased.

Other objects and advantages of the invention may appear in the course of the following description.

BRIEF DESCRIPTION OF THE DRAWINGS

The drawings illustrate the best mode presently contemplated of carrying out the invention.

In the drawings:

FIG. 3 is a partial side sectional view of the propeller shown in FIG. 2, showing the exhaust path extending through the propeller; and FIG. 4 is a sectional view taken along line 4—4 of FIG. 3 showing the propeller of the invention.

DETAILED DESCRIPTION OF THE PREFERRED EMBODIMENT

Figure 1:
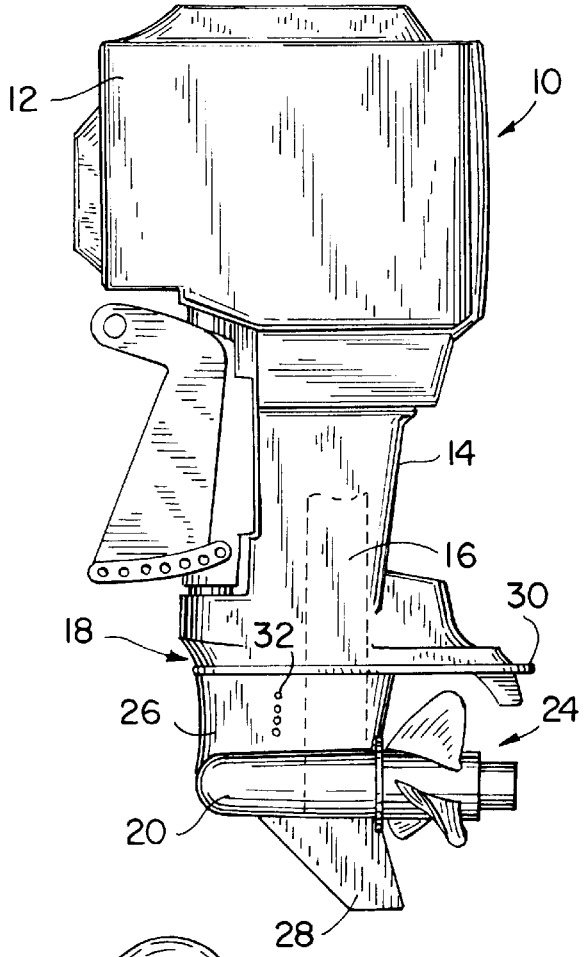
FIG. 1 is a side elevation view of an outboard marine motor and depending gear case incorporating the propeller according to the invention.

With reference to FIG. 1, an outboard motor 10 includes a power head 12 and a depending gear case 14. Power head 12 typically includes an internal combustion engine (not shown) from which exhaust is routed through an internal exhaust passage 16 formed in the gearcase 14. The internal exhaust passage 16 generally extends from the upper end of the gearcase 14 to the lower end 18 of the gear case 14, hereinafter referred to as the lower unit 18.

A torpedo gearcase 20 is formed in the lower unit 18 of the gearcase 14. The torpedo gearcase 20 houses a propeller shaft 22 (FIG. 3) to which a propeller 24 made according to the invention is mounted. The torpedo gearcase 20 is generally connected to a vertical strut 26. A lower skeg 28 is connected to the lower end of the torpedo gearcase 20.

The vertical strut 26 extends between the torpedo gearcase 20 and a cavitation plate 30 that extends over the propeller 24. The vertical strut 26 includes a series of water inlets 32 that allow cooling water to enter the marine propulsion system.

Figure 2:
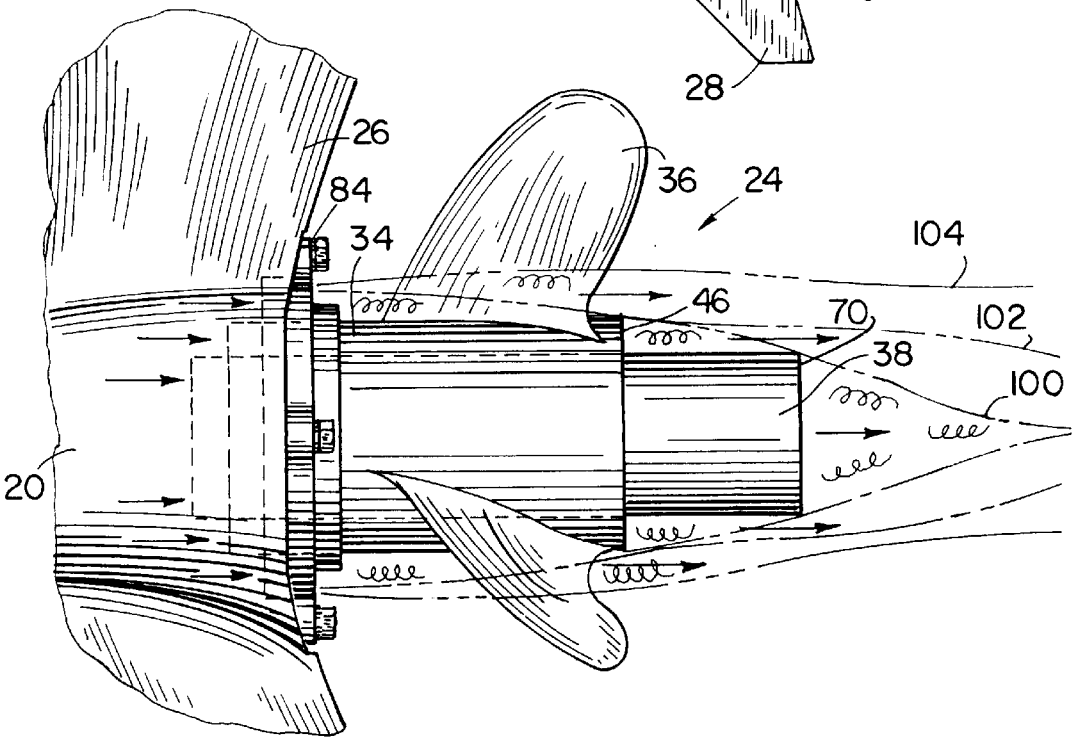
FIG. 2 is a detailed side view of a portion of the lower gear case and the propeller constructed according to the invention.

FIGS. 2–4 show the preferred embodiment of the propeller 24 which is the subject of the invention. Referring first to FIG. 2, the propeller 24 is generally comprised of a propeller hub 34, a series of propeller blades 36 and an exhaust tube 38. As shown in FIG. 3, the propeller hub 34 is a generally cylindrical structure centered about an axis of rotation and having an outer wall 40 and an inner wall 42. Each of the propeller blades 36 is securely connected to the outer wall 40 in a conventional manner. The propeller hub 34 extends between a fore end 44 and an aft end 46.

The exhaust tube 38 extends through the propeller hub 34 and is also centered around the axis of rotation of the propeller 24. The exhaust tube 38 is a generally cylindrical tube having an outer wall 48 and an inner wall 50. The diameter of the exhaust tube 38, as defined by the outer wall 48, is less than the internal diameter of the propeller hub 34, as defined by the inner wall 42. The exhaust tube 38 is securely joined to the inner wall 42 of the propeller hub 34 by a series of spokes 52, as shown in FIG. 4. Each of the spokes 52 is spaced about the outer circumference of the exhaust tube 38 such that a series of open exhaust passageways 54 are created between the outer wall 48 of the exhaust tube 38 and the inner wall 42 of the propeller hub 34. In the preferred embodiment of the invention, the series of spokes 52 are spaced along the longitudinal length of the exhaust tube 38 such that the exhaust passageways 54 are each in communication with each other. In an alternate embodiment of the invention, the spokes 52 could extend the entire longitudinal length of the propeller hub 34 such that each of the exhaust passageways 54 would be separate.

Each of the exhaust passageways 54 extend from the aft end 46 of the propeller hub 34 to the fore end 44. The exhaust passageways 54 are in communication with the lower gearcase exhaust passage 56, which is in turn in communication with the internal exhaust passage 16 contained within the gearcase 14. As shown by the arrows in FIG. 3, exhaust can pass from the internal exhaust passage 16, through the lower gearcase exhaust passage 56 and out the aft end 46 of the propeller hub 34 through the exhaust passageways 54.

The exhaust tube 38 is likewise connected to an internally positioned propeller mounting section 58. The mounting section 58 has an outer wall 60 and a splined inner diameter portion 62 which engages a splined portion 64 of the propeller shaft 22. The inner wall 50 of the exhaust tube 38 is joined to the mounting section 58 by a series of spokes 66. Each of the spokes 66 is spaced about the outer circumference of the mounting section 58, such that a second series of open exhaust passageways 68 are created between the outer wall 60 of the mounting section 58 and the inner wall 50 of the exhaust tube 38.

As with the series spokes 52 between the propeller hub 34 and the exhaust tube 38, the spokes 66 are spaced along the longitudinal length of the mounting section 58 such that the exhaust passageways 68 are in communication with each other in the preferred embodiment. Alternatively, the spokes 66 could extend the entire longitudinal length of the mounting section 58 to separate the exhaust passageways 68.

As can be seen in FIG. 3, the exhaust tube 38 extends between an aft end 70 and a fore end 72. The aft end 70 of the exhaust tube 38 is spaced longitudinally outward from the aft end 46 of the propeller hub 34, creating an extending section 74 of the exhaust tube 38. The extending section 74 surrounds an open interior 76 which permits exhaust to flow from the exhaust passageways 68 and out the aft end 70 of the exhaust tube 38. As can be appreciated by the Figure, exhaust from the internal exhaust passage 16 flows into the lower gearcase exhaust passage 56 and into the exhaust tube 38 through the opening between the inner wall 50 of the exhaust tube 38 and the propeller shaft 22 near the fore end 72 of the exhaust tube 38. The exhaust then flows through the exhaust passageways 68 located between the mounting section 58 and the inner wall 50 of the mounting tube 58. Finally, exhaust can flow into the open interior 76 of the extending section 74 and out the aft end 70 of the exhaust tube 38, as shown by the arrows in FIG. 3.

As is made clear in the preceding description, the propeller 24 of the present invention defines a pair of exhaust passages extending through the propeller. The first exhaust passage includes the exhaust passageway 68 and the open interior 76 and extends the entire length of the exhaust tube 38. The second exhaust passage is defined by the open exhaust passageways 54 between the exhaust tube 38 and the propeller hub 34. As can be appreciated by the cross-sectional view of FIG. 3, the first exhaust passage exiting through the exhaust tube 38 has a greater length than the second exhaust passage exiting through the aft end 46 of the propeller hub 34, the advantages of which will become evident in the discussion below.

The propeller 24 is securely connected to the propeller shaft 22 by a retaining nut 78 that threadedly engages a threaded portion 80 of the propeller shaft 22. The retaining nut 78 engages a mounting seat 82 contained on the mounting section 58.

A mounting bracket 84 is securely connected to the torpedo gearcase 20 by a plurality of connectors 86 which are received in a series of receptacles 88. The mounting bracket 84 contains a series of exhaust opening 90 which allow exhaust from the internal exhaust passage 16 to exit the torpedo gearcase 20 without passing through the propeller 24.

Referring now to FIG. 2, the operation of the marine propulsion system having the internal exhaust passage 16 and the propeller 24 constructed according to the invention will now be described. During low speed operation of a boat and motor having the propeller 24, the flow of water over the propeller 24 and torpedo gearcase 20 is generally shown by line 100. At low speeds, the flow of water over the torpedo gearcase 20 and the propeller 24 is generally laminar. Since the flow of water is laminar, the water will be attached to the torpedo gearcase 20 and will flow rearward from the torpedo gearcase 20 and reattach to the propeller hub 34 before the aft end 46, as shown by the flow line 100. The laminar flow of water at low boat speeds will effectively block the exit path for the exhaust out of the exhaust opening 90, as shown in FIG. 3. Additionally, as the low speed water leaves the propeller hub 34, it will reattach to the exhaust tube 38 at a point before the aft end 70, such that the flow of water will effectively prevent exhaust passing through exhaust passage 54 from exiting the aft end 46 of the propeller hub 34. Thus, at low speeds, the majority of exhaust produced by the marine propulsion system will exit the propeller 24 through the aft end 70 of the exhaust tube 38. The length of the complete exhaust path in the marine propulsion system operating at low speed will terminate at the aft end 70 of the exhaust tube 38.

At moderate speeds, the flow of water will generally follow the flow line designated 102. At this speed, water flowing over the torpedo gearcase 20 will tend to reattach to the propeller hub 34 before the aft end 46, effectively blocking exhaust from flowing through the exhaust openings 90 in much the same way as previously described for a boat operating at low speeds. However, unlike the low speed water flow 100, the moderate speed water flow 102 will not reattached to the exhaust tube 38. Therefore, exhaust passing through exhaust passageway 54 will be able to freely exit the propeller 24 through the aft end 46 of the propeller hub 34, as well as the aft end 70 of the exhaust tube 38. At moderate speed, therefore, a second exhaust path exists that terminates at the aft end 46 of the propeller hub 34, which is shorter than the single exhaust path at low speeds.

During high speed operation, the water will have turbulent flow characteristics and will flow generally along line 104. During high speed operation, the water will not reattach to either the propeller hub 34 or the exhaust tube 38 after flowing over the torpedo gearcase 20. Therefore, exhaust will be able to exit through the exhaust opening 90 contained in the torpedo gearcase. Besides exiting through the exhaust opening 90, exhaust will be able to exit through the aft end 46 of the propeller hub 34 and the aft end 70 of the exhaust tube 38. Therefore, the third exhaust path available at high speed will be measured by the exhaust leaving the exhaust opening 90, thereby providing a shorter exhaust path than available during moderate speed operation.

By using the propeller 24 as previously described, the effective length of the exhaust path varies depending upon the speed of the forward movement of the boat and motor 10. To tune the propeller for low speed operation, the length of the extending section 74 can be adjusted to an optimum value. Since the propeller hub determines the moderate speed tuning, its length can be selected for optimum performance. Since most current propellers are designed for optimum tuning at moderate speeds, the length of the propeller hub 34 can correspond to commercially available propellers. At high speeds, the exhaust path is shortened, and although the length cannot be adjusted easily due to the design of the torpedo gearcase 20, the shortened length helps to optimize turning at high speeds. Therefore, the propeller 24 can be designed such that the reflective exhaust pressure wave can be timed to more effectively aid in both scavenging and compression of the air-fuel mixture in the piston.

Although the propeller 24 has been described with a fixed exhaust tube 38 having a length which is selected before constructing the propeller 24, it is contemplated by the inventor that an alternate embodiment could include a exhaust tube 38 which can be moved with respect to the propeller hub 34 during operation of the boat and motor. Therefore, the length of the exhaust path could be modified as the speed of the engine either increases or decreases in order to provide optimum tuning.

It is thought that the present invention and its advantages will be understood from the foregoing description, the form of the invention described above being merely a preferred or exemplary embodiment of the invention. It may be apparent that various changes can be made without departure from the spirit and scope of the invention and sacrificing all of its material advantages.

I claim:

1. A propeller for use with a marine propulsion system having an internal exhaust passage and a lower gearcase, the propeller comprising:

a propeller hub having a fore end, an aft end, an inner wall and an outer wall;

a plurality of propeller blades securely fixed to the outer wall of the propeller hub;

an exhaust tube positioned within the inner wall of the propeller hub, the exhaust tube having a fore end and an aft end, the aft end of the exhaust tube extending from and past the aft end of the propeller hub;

a first exhaust passageway through the propeller passing through the exhaust tube and extending from the fore end to the aft end of the exhaust tube; and a second exhaust passageway through the propeller passing between the inner wall of the propeller hub and an outer wall of the exhaust tube and extending between the fore end and aft end of the propeller hub.

2. The propeller of claim 1, wherein the exhaust tube is connected to the inner wall of the propeller hub.

3. The propeller of claim 2, wherein the exhaust tube is securely connected to the propeller hub by a series of circumferentially spaced spokes.

4. The propeller of claim 1, wherein the fore end of the propeller hub and the fore end of the exhaust tube are configured to be in communication with the internal exhaust passage of the marine propulsion system.

5. The propeller of claim 1, wherein the aft end of the exhaust tube extends past the aft end of the propeller hub by a selected distance.

6. An exhaust tuning system for a marine propulsion system having an internal combustion engine and a lower gearcase, the system comprising:

an internal exhaust passage extending from the engine through the lower gearcase; and a propeller having a propeller hub, an exhaust tube, a first exhaust passageway through the propeller hub extending from the internal exhaust passage through the exhaust tube, and a second exhaust passageway through the propeller hub extending from the internal exhaust passage through a space between the propeller hub and the exhaust tube, the second exhaust passageway being shorter than the first exhaust passageway.

7. The exhaust tuning system of claim 6, wherein the propeller hub and the exhaust tube are securely connected and spaced from each other by a series of circumferentially spaced spokes.

8. The exhaust tuning system of claim 6, further comprising a propeller mounting bracket securely connected to the lower gearcase for mounting the propeller to the lower gearcase, the mounting bracket having a series of exhaust openings, said exhaust openings defining a third exhaust passageway.

9. An exhaust tuning system for a marine propulsion system having an internal combustion engine and a lower gearcase, the system comprising:

an internal exhaust passage extending from the engine through the gearcase;

a propeller having a fore end, an aft end, an inner wall, an outer wall;

an inner exhaust path passing through the propeller and extending from the internal exhaust passage through the interior of the propeller defined by the inner wall and terminating at the aft end of the propeller;

an outer exhaust path extending from the internal exhaust passage through a series of exhaust openings positioned radially outward from the outer wall of the propeller such that exhaust from the engine will pass along the exterior of the propeller hub;

an exhaust tube positioned within and spaced from the inner wall of the propeller, the exhaust tube having a fore and an aft end, the aft end of the exhaust tube extending rearwardly from the aft end of the propeller.

10. The exhaust system of claim 9 wherein the inner exhaust path includes a first exhaust passageway located in the interior of the exhaust tube and extending from the fore end to the aft end of the exhaust tube and a second exhaust passageway extending through the space between the inner wall of the propeller and the exhaust tube, the second exhaust passageway extending between the fore end and the aft end of the propeller hub.

11. The propeller of claim 10, wherein the first exhaust passageway is longer than the second exhaust passageway.

12. The propeller of claim 11 wherein the second exhaust passageway is longer than the outer exhaust path.

* * * * *